US008047545B2

(12) United States Patent
Thinnes et al.

(10) Patent No.: US 8,047,545 B2
(45) Date of Patent: Nov. 1, 2011

(54) LOTTERY-TYPE GAME WITH ROLLOVER FEATURE

(75) Inventors: William Thinnes, Wilmette, IL (US); James Zalabak, Bolingbrook, IL (US); James Bahry, Crystal Lake, IL (US)

(73) Assignee: Douglas Press, Inc., Bellwood, IL (US)

( * ) Notice: Subject to any disclaimer, the term of this patent is extended or adjusted under 35 U.S.C. 154(b) by 0 days.

(21) Appl. No.: 12/291,209

(22) Filed: Nov. 7, 2008

(65) Prior Publication Data

US 2009/0160129 A1 Jun. 25, 2009

Related U.S. Application Data

(60) Provisional application No. 60/986,209, filed on Nov. 7, 2007.

(51) Int. Cl.
*A63B 71/00* (2006.01)

(52) U.S. Cl. ..... 273/139

(58) Field of Classification Search ..... None
See application file for complete search history.

(56) References Cited

U.S. PATENT DOCUMENTS

| | | | | | |
|---|---|---|---|---|---|
| 3,900,219 | A * | 8/1975 | D'Amato et al. | ..... | 283/101 |
| 4,033,611 | A * | 7/1977 | Johnsen | ..... | 283/101 |
| 4,740,016 | A * | 4/1988 | Konecny et al. | ..... | 273/139 |
| 5,046,737 | A * | 9/1991 | Fienberg | ..... | 273/139 |
| 5,092,598 | A * | 3/1992 | Kamille | ..... | 273/139 |
| 5,407,200 | A * | 4/1995 | Zalabak | ..... | 273/139 |
| 5,671,921 | A | 9/1997 | Quinlan | | |
| 5,743,524 | A | 4/1998 | Nannicola | | |
| 5,788,237 | A * | 8/1998 | Fults et al. | ..... | 273/269 |
| 5,934,671 | A | 8/1999 | Harrison | | |
| 6,210,275 | B1 | 4/2001 | Olsen | | |
| RE37,371 | E | 9/2001 | Gerow | | |
| 6,305,687 | B1 | 10/2001 | Pollock et al. | | |
| 6,309,398 | B1 * | 10/2001 | Florke | ..... | 606/131 |
| 6,599,187 | B2 | 7/2003 | Gerow | | |
| 6,612,576 | B1 * | 9/2003 | Stancik et al. | ..... | 273/139 |
| 6,880,824 | B2 * | 4/2005 | Thinnes | ..... | 273/139 |
| 2003/0030211 | A1 | 2/2003 | Brown | | |
| 2006/0119032 | A1 | 6/2006 | Scrymgeour et al. | | |
| 2006/0197283 | A1 | 9/2006 | Thinnes | | |
| 2006/0258433 | A1 | 11/2006 | Finocchio et al. | | |

OTHER PUBLICATIONS

Win on Diamonds, Form 0793, 1989, International Games, Inc.
Bonus 300, Form SC438-C, 1998, Douglas Press, Inc., Bellwood, IL.
2 for the Money, form SC465-C, 1999, Douglas Press, Inc., Bellwood, IL.
King of the Mountain, Form #1520, 1994, Douglas Press, Inc., Bellwood, IL.

* cited by examiner

*Primary Examiner* — Alvin A Hunter
*Assistant Examiner* — Dolores Collins
(74) *Attorney, Agent, or Firm* — Greenberg Traurig, LLP

(57) ABSTRACT

Disclosed is a lottery-type game which involves providing a plurality of playing cards, each of which having one or more game symbols displayed thereon, and a master game card. The game further involves distributing at least a portion of the playing cards to a plurality of individual players and selecting one or more of the individual players having playing cards displaying predetermined selected ones of the game symbols. The game further includes determining whether one or more of the selected individual players are winners of primary prizes associated with an initial and a subsequent level of play. If none of the selected individual players are determined to be winners of the primary prize value associated with the initial level of play, at least a portion of the primary prize value associated with the initial level of play is rolled over into a primary prize value associated with the subsequent level of play.

26 Claims, 9 Drawing Sheets

LOTTERY-TYPE GAME WITH ROLLOVER FEATURE

BACKGROUND

1. Field

The present invention relates generally to lottery-type game systems.

2. Background

One type of lottery-type game system which has proven quite popular with players are the so-called break-open or jar ticket games. In this type of game, players purchase playing cards or tickets for a monetary sum. Each playing card displays game symbols, selected ones of which correspond to prize values. In a typical configuration, each playing card comprises a lamination of an upper ply and a lower ply of material, such as paper, with the game symbols printed on the inside surface of the lower ply. The game symbols are thus initially sealed and hidden from view by the upper ply and are revealed only by "breaking open" one or more flap-like portions die-cut into the upper ply. Game symbols may also be hidden by other concealing means, including scratch-off, optical and other covering methods commonly known in the art. In addition to the entertainment value such games provide for players, these types of games may also provide a source of revenue for the operator, be it a municipality, a charity, or business establishment.

As will be appreciated, affording players an opportunity to win prizes in different ways enhances the entertainment value of a game. One form of game provides for selected players to become eligible for a prize, with at least one of these players, in turn, having an opportunity to win the prize. Providing game players the opportunity to win prizes enhances the entertainment value of the game. Implementation of such prizes is often accomplished through the use of a master game card that is associated with the particular set or sets of playing cards. Examples of such game systems are illustrated in U.S. Pat. Nos. 5,046,737 and 5,407,200. By enhancing the entertainment value of such a game, player interest in the game and, in turn, the potential revenues generated from the sale of game tickets to such players, is also enhanced.

SUMMARY

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

An embodiment of the present invention is directed to an apparatus for controlling play of a lottery-type card-based game. The apparatus includes a plurality of playing cards, each of which having one or more game symbols displayed thereon, and a master game card for use in conjunction with the plurality of playing cards. At least one of the master game card and the plurality of playing cards includes an eligibility indicator for establishing the eligibility of one or more selected game players holding playing cards displaying predetermined selected ones of the game symbols. The master game card further includes a first prize identifier for determining whether there is a winner of a primary prize associated with an initial level of play and a second prize identifier for determining whether there is a winner of a primary prize associated with a subsequent level of play in the same game as the first level of play. The apparatus further includes indicia displayed on at least one of the master game card and the plurality of playing cards for indicating that if there is no winner of the primary prize associated with the initial level of play, a winner of the primary prize associated with the subsequent level of play also wins at least a portion of the primary prize associated with the initial level of play.

Another embodiment of the present invention is directed to a method of playing a lottery-type card-based game. The method involves providing a plurality of playing cards, each of which having one or more game symbols displayed thereon, as well as at least one master game card for use in conjunction with the playing cards. At least a portion of the playing cards are distributed to a plurality of individual players. One or more of the individual players having playing cards displaying predetermined selected ones of the game symbols are selected. Using at least one master game card, determinations are made as to whether one or more of the selected individual players is a winner of a primary prize associated with an initial level of play identified by at least one master game card, and whether one or more of the selected individual players is a winner of a primary prize value associated with a subsequent level of play identified by at least one master game card. At least a portion of the primary prize value associated with the initial level of play, in addition to the primary prize value associated with the subsequent level of play, is awarded to a winner of the primary prize value associated with the subsequent level of play, if, during the initial level of play, none of the selected individual players are determined to be winners of the primary prize associated with the initial level of play.

Another embodiment of the present invention is directed to a system for controlling play of a lottery-type card-based game. The system includes a plurality of playing cards, each of which having one or more game symbols displayed thereon. The playing cards also have displayed thereon indicia for establishing the eligibility of one or more selected game players having playing cards displaying predetermined selected ones of the game symbols for additional levels of play. The system also includes a symbol selection device for use in conjunction with the plurality of playing cards. The symbol selection device is operable to indicate a first symbol for determining whether there is a winner of a primary prize value associated with an initial level of play and a second symbol for determining whether there is a winner of a primary prize value associated with a subsequent level of play in the same game as the initial level of play. The playing cards also include indicia displayed thereon for indicating that if, during the initial level of play, there is no winner of the primary prize associated with the initial level of play, a winner of the primary prize associated with the subsequent level of play also wins at least a portion of the primary prize value associated with the initial level of play.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Figure 1:
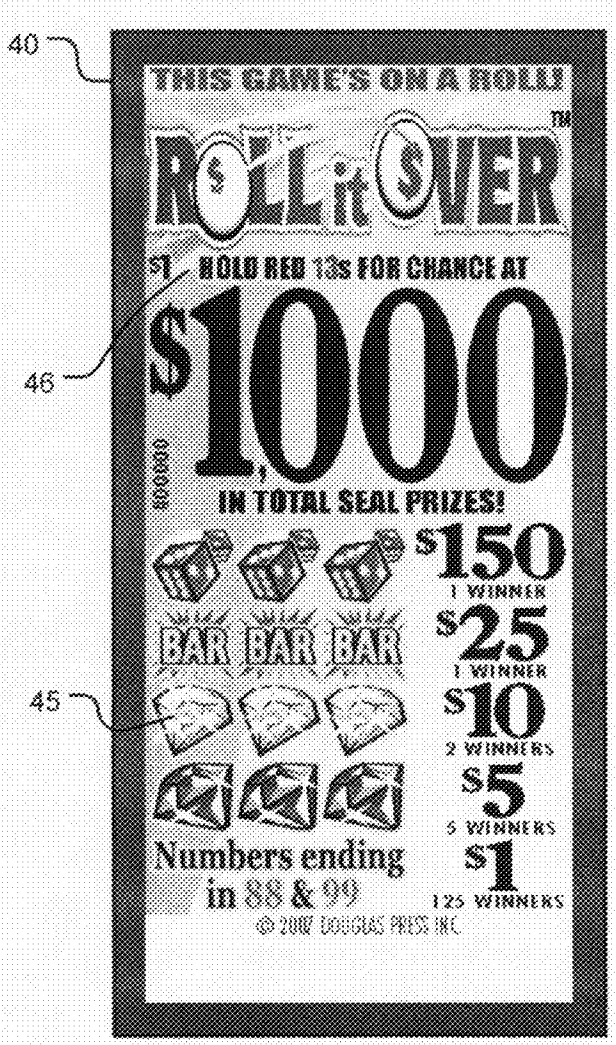
FIG. 1 is a plan view illustrating an outside surface of an upper ply of a playing card or ticket, in accordance with various embodiments of the present invention.
Figure 2:
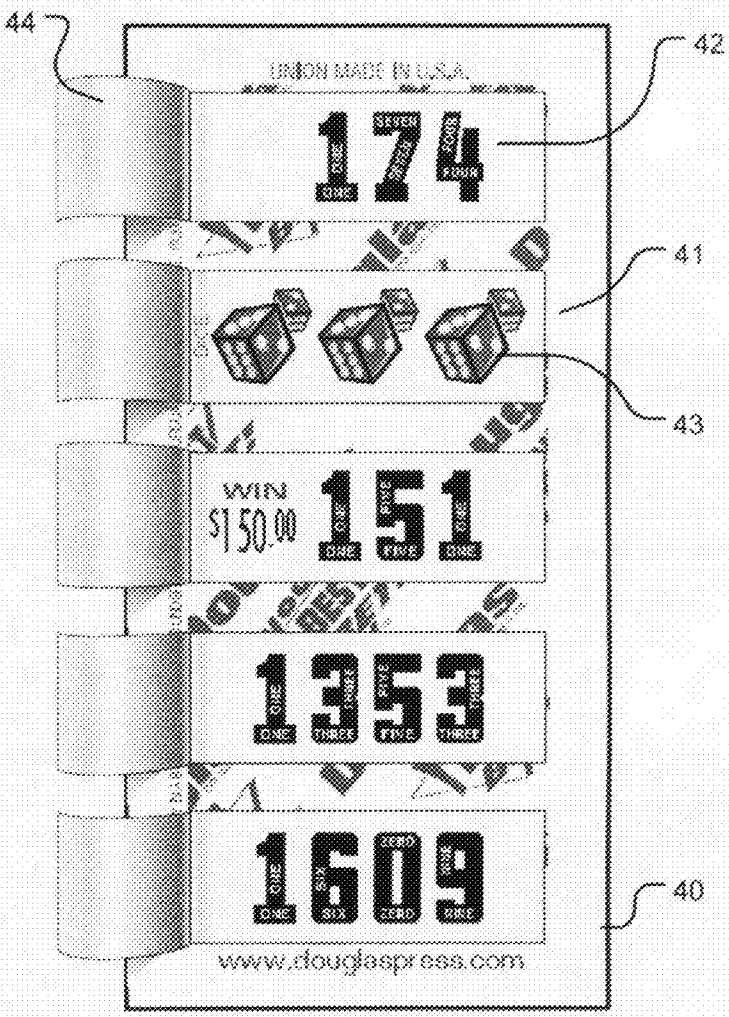
FIG. 2 is a plan view illustrating an outside surface of a lower ply of a playing card or ticket and the underlying inside surface of the top ply, in accordance with various embodiments of the present invention.

Reference will now be made in detail to preferred embodiments of the invention, examples of which are illustrated in the accompanying drawings. While the invention will be described in conjunction with preferred embodiments, it will be understood that they are not intended to limit the invention to these embodiments. On the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures, and components have not been described in detail as not to unnecessarily obscure aspects of the present invention.

OVERVIEW

Briefly stated, embodiments generally provide for a lottery-type game system with a rollover feature. The game involves using a master game card in conjunction with other individual player game cards or tickets. Certain individual game players having playing cards displaying predetermined symbols are selected for two or more bonus levels of play based on the master game card. If none of the selected players wins the first level of play, the prize associated with the first level gets rolled over into the next level of play, and so on, until a level is won.

Exemplary Lottery-Type Game Systems

FIGS. 1-7 illustrate various embodiments of a master game card 10 and playing card or ticket 40 for a lottery-type game system. Playing card or ticket 40 represents a typical card useable in the present game system. In one embodiment, each of these playing cards or tickets 40 is purchased by a game player, with certain ones of the players being eligible to participate in two or more levels of play on the master game card 10, with or without prior or subsequent opportunities to win prizes or awards.

Each of the playing cards 40 preferably comprise a lamination of an upper ply 41 and a lower ply 42 of material, such as paper or the like. Each of the playing cards 40 displays one or more game symbols 43, which are displayed on the inside surface of the lower ply 42 of the card in one embodiment. This type of card is typically referred to as a "break-open" playing card, in that flap-like portions 44 of the upper ply 41 can be selectively lifted or removed from each of the game symbols 43 in order to reveal the game symbols after the card has been purchased. However, it will be understood that a game embodying the principles of the present invention may include playing cards 40 and a master game card 10 otherwise configured, including, but not limited to, "scratch-off" arrangements for initially concealing game symbols.

In play of the game, the present game system provides prizes to those players having playing cards 40 which display predetermined winning prize symbols 45. In its one or more levels of play, the present system permits selected ones of the players to become eligible for at least one prize, through use of the master game card 10. The playing cards 40 and/or the master game card 10 may include indicia 46 to that end.

Another aspect of the present game system entails establishing selected game players who become eligible to play in a plurality of additional levels of play 21-24, with these players then listed on the master game card 10 in the illustrated embodiment. To this end, the master game card 10 may include a list arrangement 14 for listing the selected, eligible players, such as by handwriting in blanks provided. In the illustrated embodiment, the eligibility of these selected players is established by those players having cards 40 containing predetermined selected ones of the game symbols, be they graphics, letters, numbers or the like. The predetermined selected ones of the game symbols may be indicated on the master game card 10, on the player cards 40, or both. In the illustrated embodiment, such predetermined game symbols comprise numeric designations—in particular numeric designations ending in the digits "13" (i.e., 013, 113, 213, etc.). In another embodiment, the predetermined game symbols may correspond to particular bingo balls, i.e. 1-75, and/or other groups of numbers, letters, or graphics. In another embodiment, the illustrated game may also permit the player who purchases the last playing card of the set to be eligible for the prize by entry in a "last sale" listing (not illustrated). This may be reflected in list 14, for example.

In another embodiment, the eligibility of one or more selected players is established through a raffle. The raffle may be a traditional raffle, in that the selected players are established through a drawing. Alternatively, the raffle may involve a raffle card, which includes concealed indicia of the one or more selected players. During game play, the indicia is revealed, thereby establishing the one or more selected players. The indicia may indicate, for example, one or more numbers corresponding to one or more of the playing cards.

The levels of play 21-24 of the master game card 10 provide the additional levels of play of the present system. In one embodiment, the master game card 10 may include a plurality of identifiers 18 printed on the inside surface of lower ply 12, each of which is concealed by a respective flap-like portion 19 of the upper ply 11. In the illustrated embodiment, the identifiers 18 either identify one or more of the selected players as having won a prize at the associated level of play or indicate that none of the selected players have won a prize for the associated level of play. In the first level of play 21, at least one of the identifiers 18 indicates that none of the selected players have won a prize for the first level of play 21. It should be appreciated that although FIG. 3 depicts a master card 10 having four levels of play, other embodiments are possible as long as there are at least two bonus levels.

Figure 3:
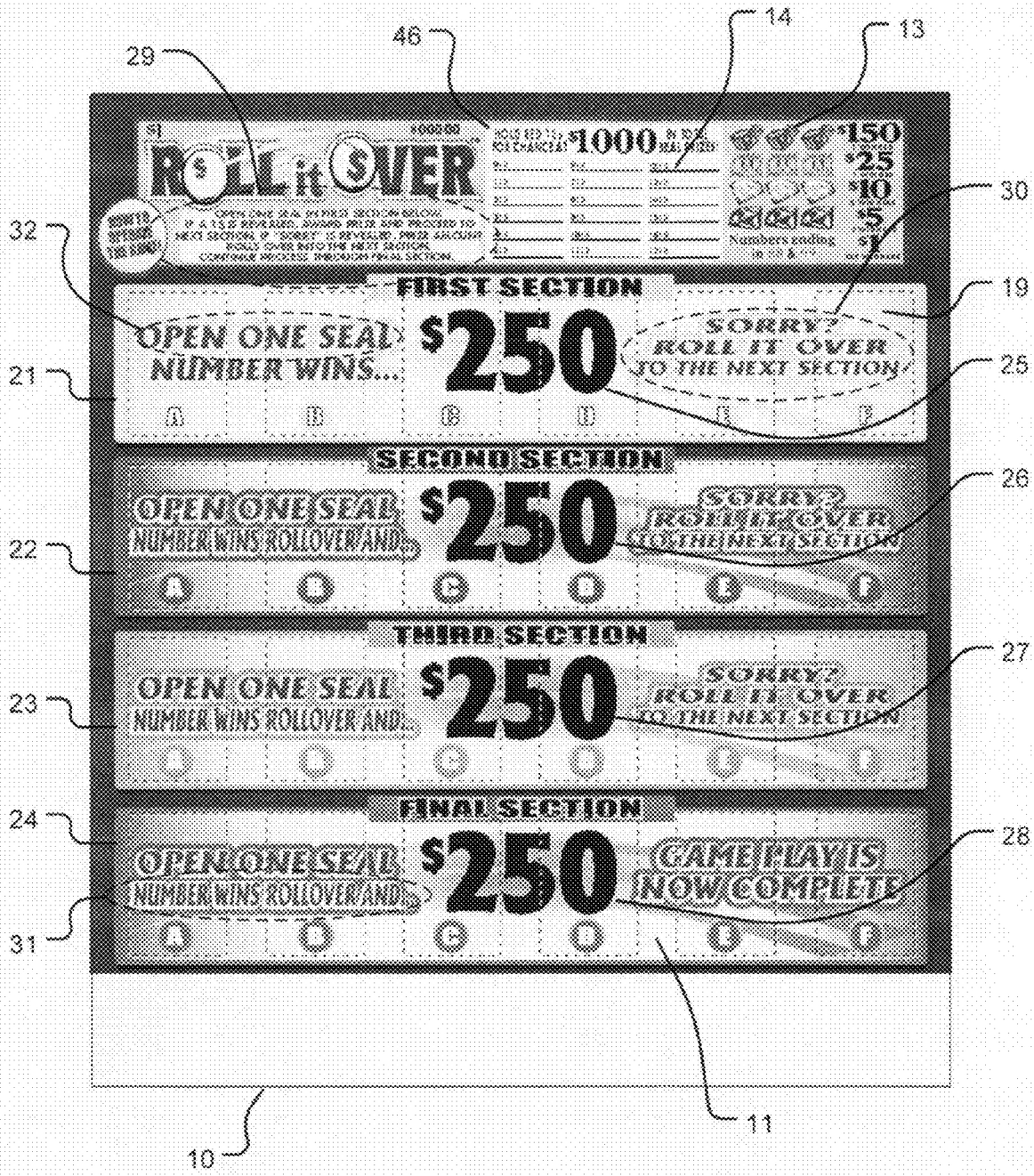
FIG. 3 is a plan view illustrating the outside surface of an upper ply of a master game card, in accordance with various embodiments of the present invention.

In the embodiment illustrated in FIG. 3, it is contemplated that an individual (e.g., a game operator, a player, etc.) will open only one of the flap-like portions 19 in each of the successive levels of play. In one embodiment, the master card 10 includes indicia 32 to that end. In an embodiment where a player selects which flaps 19 to open, such player may be determined through a selection process. This process may involve a raffle similar to those described above. Alternatively, a player holding a player card 40 displaying a predetermined symbol may be designated the "picker."

The values of the respective prizes for each level of play are preferably prominently displayed at regions 25-28 on the master game card 10 so that game players are aware of the potential prizes available to be won. Although the prize values 25-28 of the levels of play 21-24 in FIG. 3 are depicted as being equal to each other (i.e., all $250), it should be appreciated that the prize values may vary from level to level. For example, in one embodiment, the prize values may progressively increase (e.g., $250, $500, $750, etc.) as the levels of play change.

Thus, the first level of play begins by revealing an identifier 18 in the first level 21. If the identifier 18 that is revealed identifies one or more of the selected players, the prize value associated with the first level 21 is awarded to the identified player(s). If, on the other hand, the revealed identifier 18 indicates that none of the selected players has won a prize at the first level (e.g., "try again," "sorry," "roll it over," etc.), the prize value assigned to the first level "rolls into" the prize value corresponding to the second level of play 22. For example, according to the illustrated embodiment of FIG. 4, if window "C" of the first level 21 is revealed, then the player associated with the symbol "1213" wins $250. On the other hand, if any of the other identifiers of the first level of play 21 are revealed, none of the selected players win at the first level of play 21, and therefore the associated $250 prize is rolled over into the second level of play.

Figure 5:
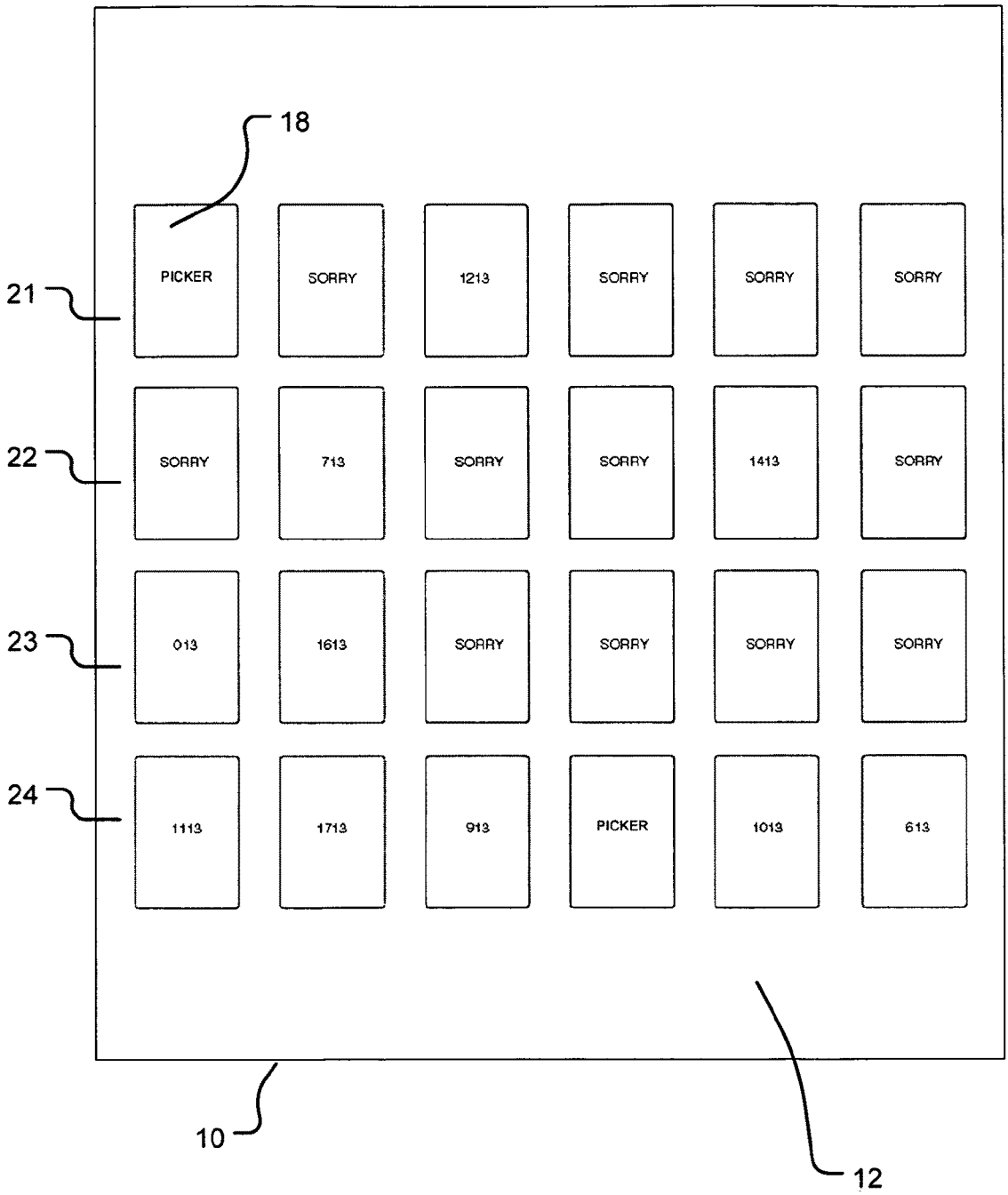
FIG. 5 is a plan view illustrating the underlying inside facing surface of a lower ply of a master game card, for use in a "picker" style of play, the printed portions of which master game card are aligned with die cut openings in the upper ply of the game card, in accordance with various embodiments of the present invention.
Figure 6:
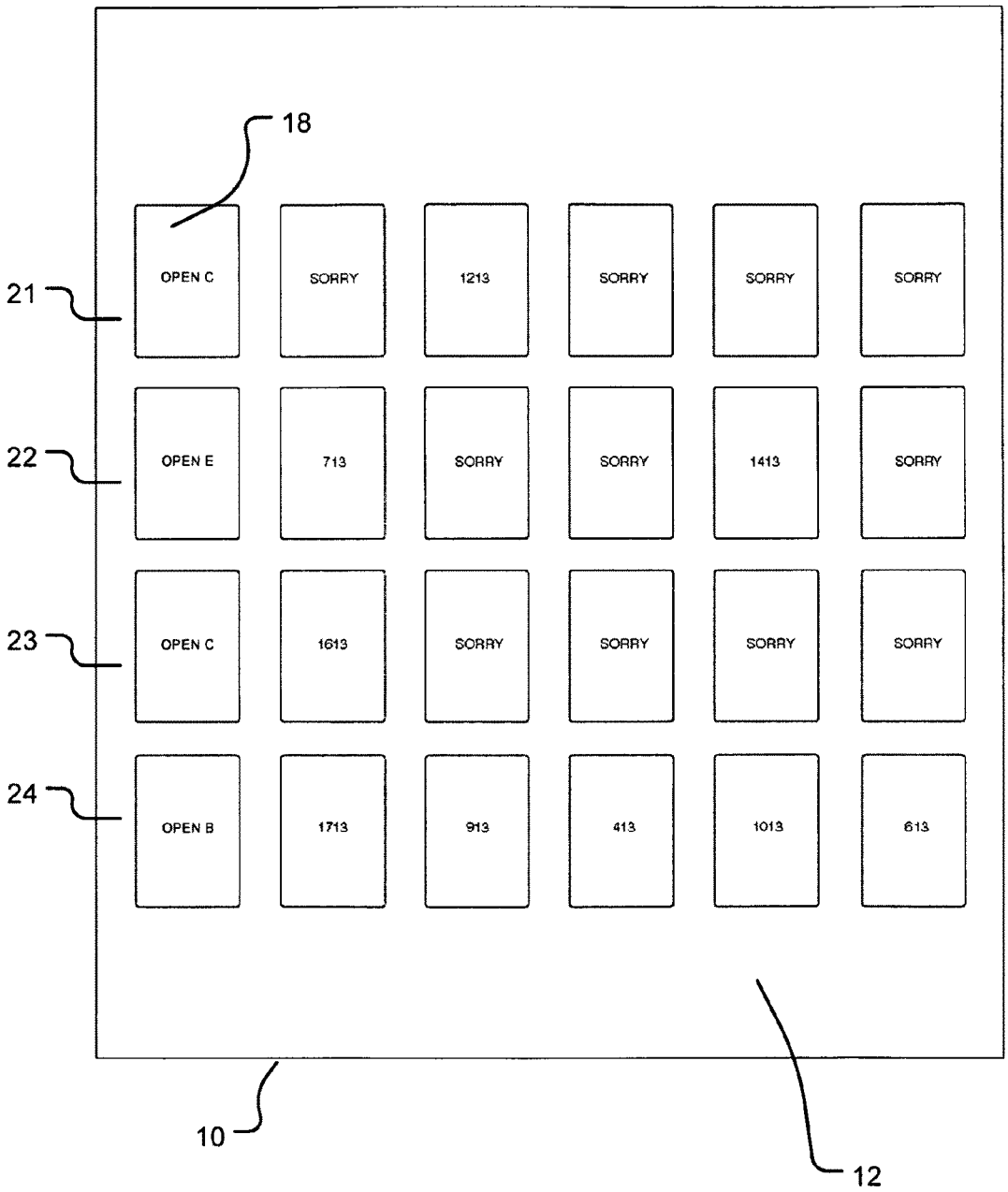
FIG. 6 is a plan view illustrating the underlying inside facing surface of a lower ply of a master game card, for use in a "directive" style of play, the printed portions of which master game card are aligned with die cut openings in the upper ply of the game card, in accordance with various embodiments of the present invention.

If a "picker" player is designated, some of the identifiers 18 may specifically identify the picker. For example, as shown in FIG. 5, the picker is a winner if window "A" of the first level 21 or window "D" of the fourth level 24 is opened. Similarly, if one or more of the selected players was selected through a raffle, some of the identifiers 18 may specifically identify the raffle winner(s)—by displaying the word "RAFFLE," for example.

If none of the selected players wins in the first level of play, the players selected for the second level of play would then be eligible for an accumulated prize of $500 in the second level 22. Similarly, if none of the selected players is identified as a winner of the second level of play 22, the $500 accumulated prize from the second level of play is rolled over into the third level of play 23, with selected players for the third level therefore being eligible for $750 in the third level of play 23, and so on through the remaining level(s) of play. To this end, the master card 10 includes indicia 29 and 30 indicating that if none of the selected players has won a particular level of play, the prize associated with that level of play rolls over into the prize for the next consecutive level of play.

In one embodiment, multiple identifiers 18 are revealed. For example, in an embodiment where two player identifiers 18 are revealed at each level, there are two prizes available at each level of play. If both identifiers 18 that are revealed in a given level identity a selected player, the identified players are awarded the prizes associated with that level. If both identifiers 18 indicate that none of the selected players has won the corresponding prize (e.g., "try again," "sorry," "roll it over," etc.), both prizes are rolled over to the second level of play. If one of the identifiers 18 identifies a selected player and the other does not, one prize is awarded and one prize is rolled over to the second level of seal card play. This style of play may continued for any number of additional levels of play.

In another embodiment, the master card 10 provides for "directed" play. In directed play, each level of play begins by first revealing a predetermined one of the identifiers 18. This identifier then provides a directive as to which other identifier 18 in that level of play should be opened next. The next identifier 18 revealed will then indicate which of the selected players, if any, wins the corresponding prize for that level of play. For example, in the embodiment illustrated in FIG. 6, window "A" is opened first in each level of play. Behind each window "A" is a directive to open a different window in that level. For instance, in the first level of play 21, window "A" is first opened to reveal the directive "OPEN C". In accordance with the directive, window "C" is opened next, thereby revealing that player number 1213 wins the prize corresponding to the first level 21—$250 in this example.

In one embodiment, it may be desirous to ensure that all the prizes are ultimately awarded. In such a case, the identifiers 18 may be arranged such that all of the identifiers 18 associated with a final level of play 24 each identify at least one selected player. Thus, regardless of how many previous prizes may or may not be rolled into the final level of play, it is guaranteed that upon the conclusion of the final level of play, all of the prizes will have been awarded.

Similarly, it may be desirous to ensure that a prize is awarded in certain intermediate levels of play. In such a case, the identifiers 18 of the certain intermediate levels may be arranged such that they each identify at least one selected player. Thus, regardless of how many previous prizes may or may not be rolled into the intermediate level of play, it is guaranteed that upon the conclusion of such level of play, all of the prizes of the previous levels will have been awarded.

To further enhance entertainment value, it may be desirous to repeat a particular player identifier 18 associated with one or more selected players in multiple levels of play. For example, in the embodiment of FIG. 4, the selected player associated with the game symbol "1213" is unknowingly a potential winner in both the first level of play 21 and the final level of play 24. Similarly, the selected player associated with the game symbol "713" is unknowingly a potential winner in both the second level of play 22 and the final level of play 24. In other embodiments, it may not be desirous to repeat any player identifiers 18 that identify selected players. It should be appreciated that in the present mode of play, the odds of winning a particular level of play is not a function of how many previous bonus levels have been played. Put differently, the odds of winning one level of play are independent from the odds of winning another.

As a further means of enhancing entertainment value, a winner of a particular level of play (e.g. the final level of play 24) may be given an opportunity to play in a "jackpot" level of play. In the jackpot level, a jackpot identifier 18 is revealed which indicates either that the player wins the jackpot (e.g. by displaying "jackpot," "winner," etc.) or that the player does not win the jackpot (e.g., "try again," "sorry," etc.). If the jackpot is not won, the value of the jackpot prize may roll over from game to game until a player wins the jackpot. The master card 10 may include indicia to that end.

Figure 7:
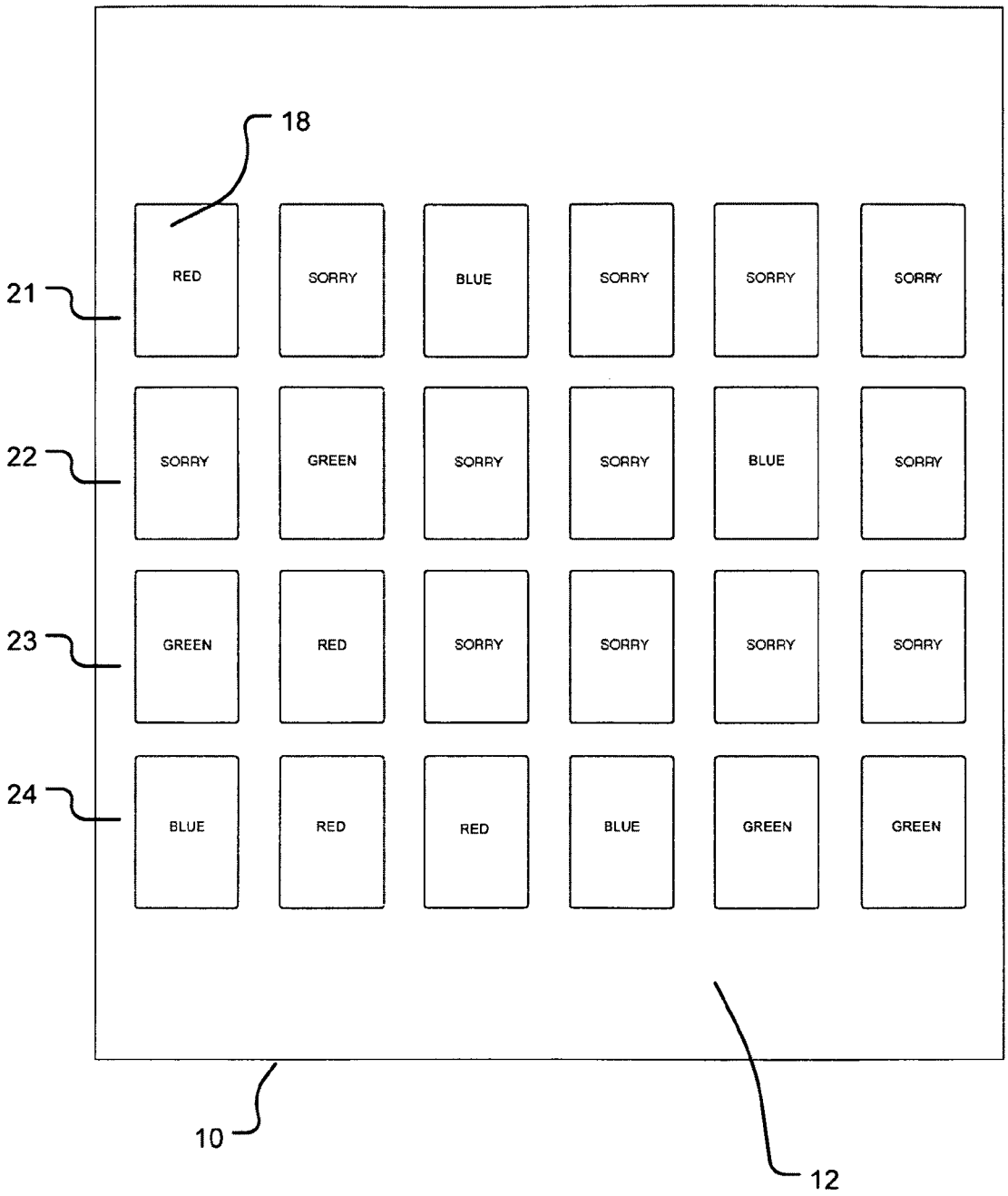
FIG. 7 is a plan view illustrating the underlying inside facing surface of a lower ply of a master game card, for use in a color-coded raffle style of play, the printed portions of which master game card are aligned with die cut openings in the upper ply of the game card, in accordance with various embodiments of the present invention.

Embodiments of the present invention also provide for several variations in which a raffle process is used, which allow for more than one raffle winner to play on the master card 10. In one embodiment, multiple (e.g. three) identical sets of raffle numbers are created. Each set of raffle numbers is coded—for example, by color (e.g. red, blue and green) or by some equivalent coding method—so as to distinguish the sets. The winning number is then identified by the raffle. In this example, because of the color-coding, three players qualify for play on the master card 10. Play on the master card 10 works as described above, except that the word "RED," "BLUE" or "GREEN" appears instead of a number to reveal which player wins at that level, as shown in FIG. 7.

In another embodiment, more than one winning raffle number holder may play on the master card 10 by using a portion of a raffle number and completing it in the master card play. For example, the first two digits of a three-digit raffle number may be determined through a raffle. A window is then opened on the first level of play 21 on the master card 10 to reveal one digit or "SORRY" (or an equivalent to "SORRY"). If "SORRY" is revealed, the prize amount is rolled over to the second level of play 22. If a number (0-9) is revealed, the player holding the playing card 40 displaying the number with the first two digits identified in the raffle and the last digit revealed on the master card 10 is awarded the prize associated with that level. At the next level of play, "SORRY" or a new number (0-9) can be revealed completing a winning raffle number by adding the new final digit to the previously identified first and second raffle number digits, and so on.

Exemplary Drawing-Type Game Systems

An alternative embodiment of the present invention may be played in conjunction with a symbol identification device, such as a bingo ball blower, a roulette wheel or other numbered wheel, a computerized random symbol generator, or the like. The symbols may be letters, numbers, colors, or other graphical symbols. While the following discussion may describe particular embodiments with respect to a bingo blower or drawing device, it shall be appreciated that any other suitable symbol identification device may be used instead.

FIGS. 8-13 illustrate a master game card 110 and playing card or ticket 140 for a bingo-type game system, in accordance with an embodiment of the present invention.

While the present embodiment may be described with reference to master card 110, it should be appreciated that other embodiments may not use such a master card.

Figure 4:
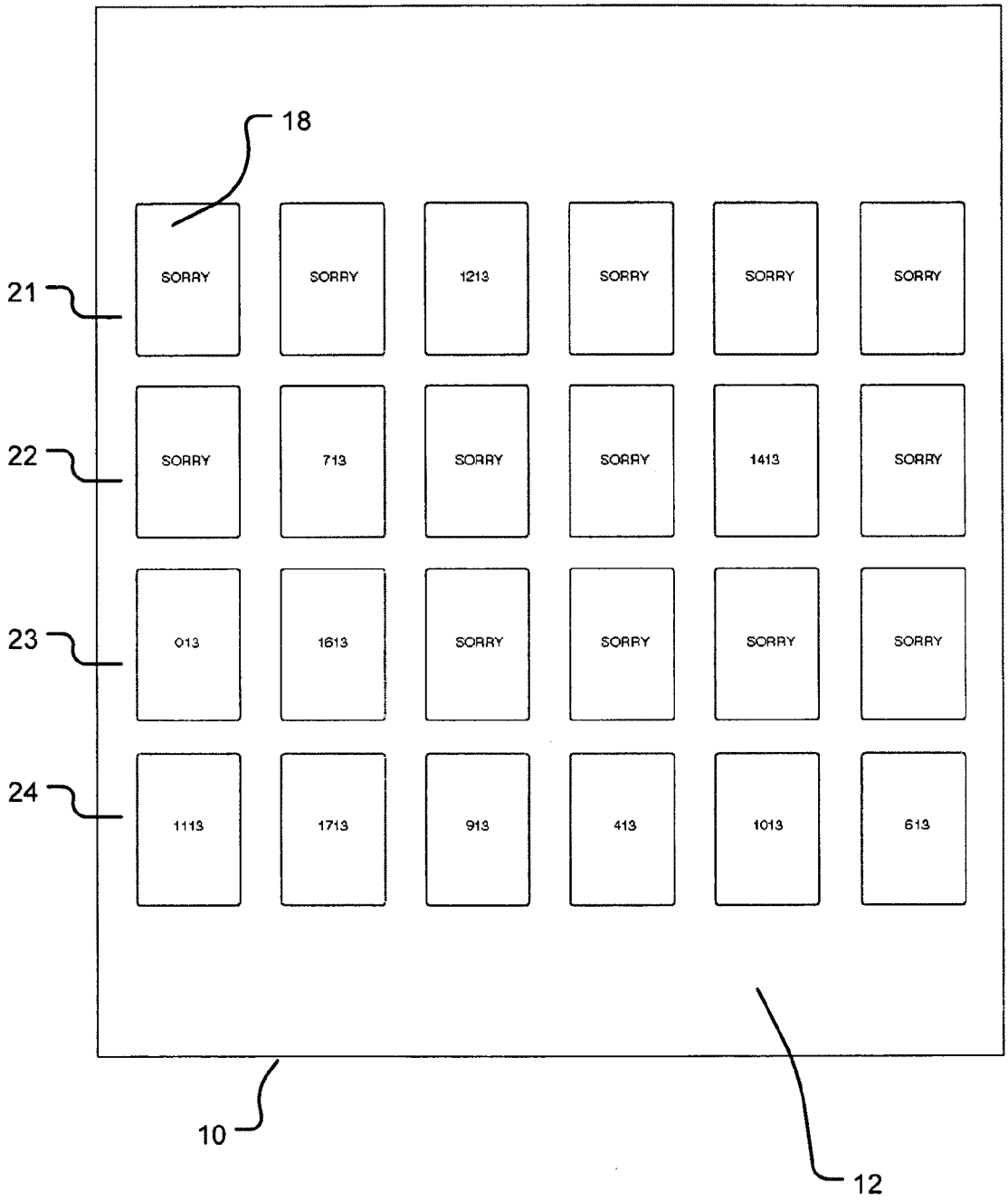
FIG. 4 is a plan view illustrating the underlying inside facing surface of a lower ply of a master game card, the printed portions of which are aligned with die cut openings in the upper ply of the game card, in accordance with various embodiments of the present invention.
Figure 9:
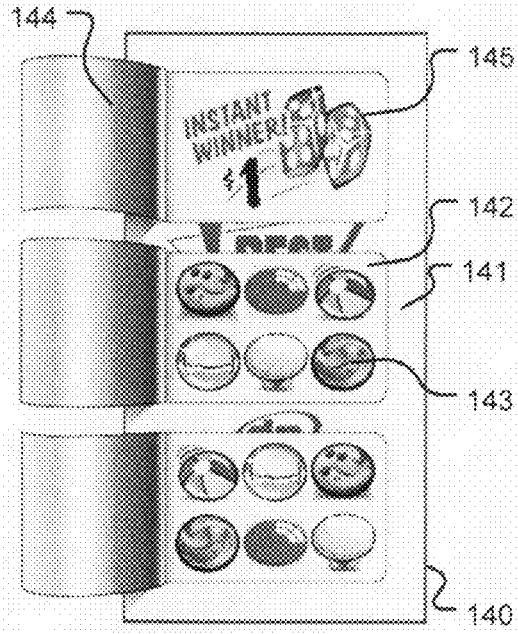
FIG. 9 is a plan view illustrating an outside surface of a lower ply of a playing card and the underlying inside surface of the top ply, showing an instant winning symbol, in accordance with various embodiments of the present invention.
Figure 10:
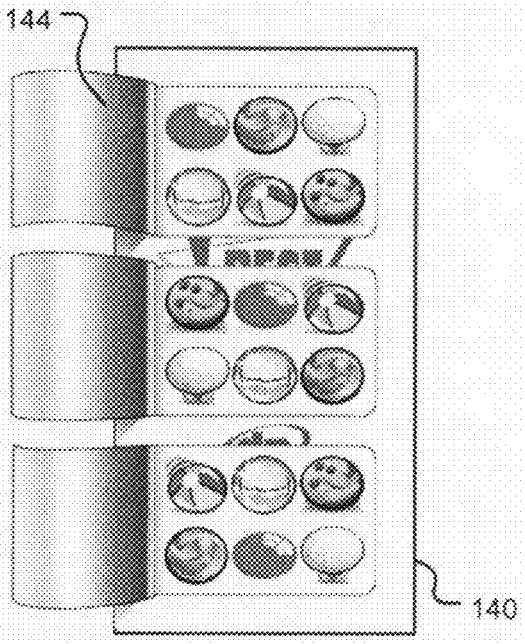
FIG. 10 is a plan view illustrating an outside surface of a lower ply of a playing card and the underlying inside surface of the top ply, in accordance with various embodiments of the present invention.
Figure 11:
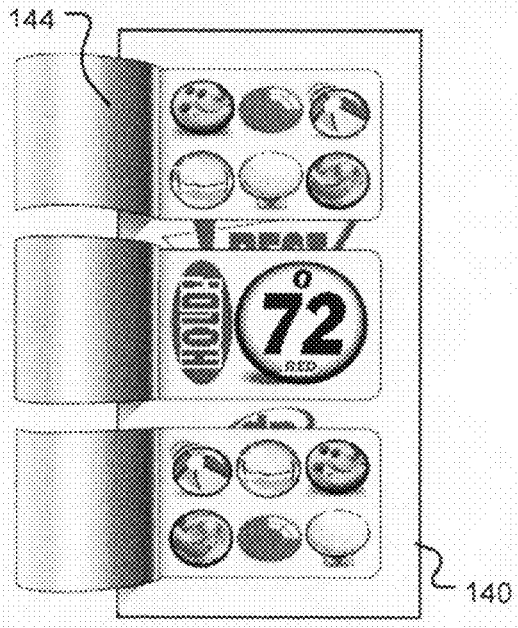
FIG. 11 is a plan view illustrating an outside surface of a lower ply of a playing card and the underlying inside surface of the top ply, showing a symbol qualifying the holder for a additional level of play, in accordance with various embodiments of the present invention.
Figure 12:
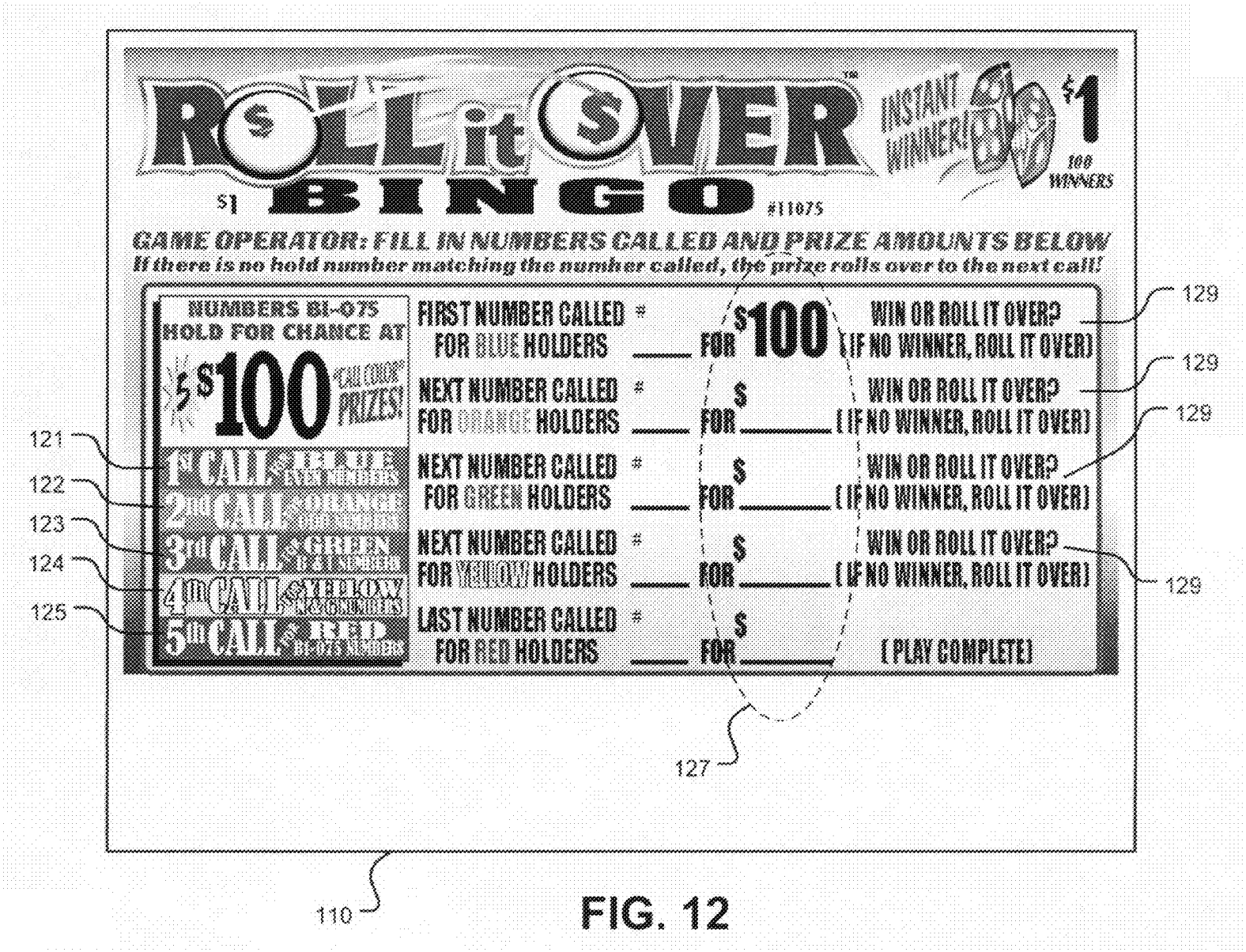
FIG. 12 is plan view illustrating a master game card, in accordance with various embodiments of the present invention.
Figure 13:
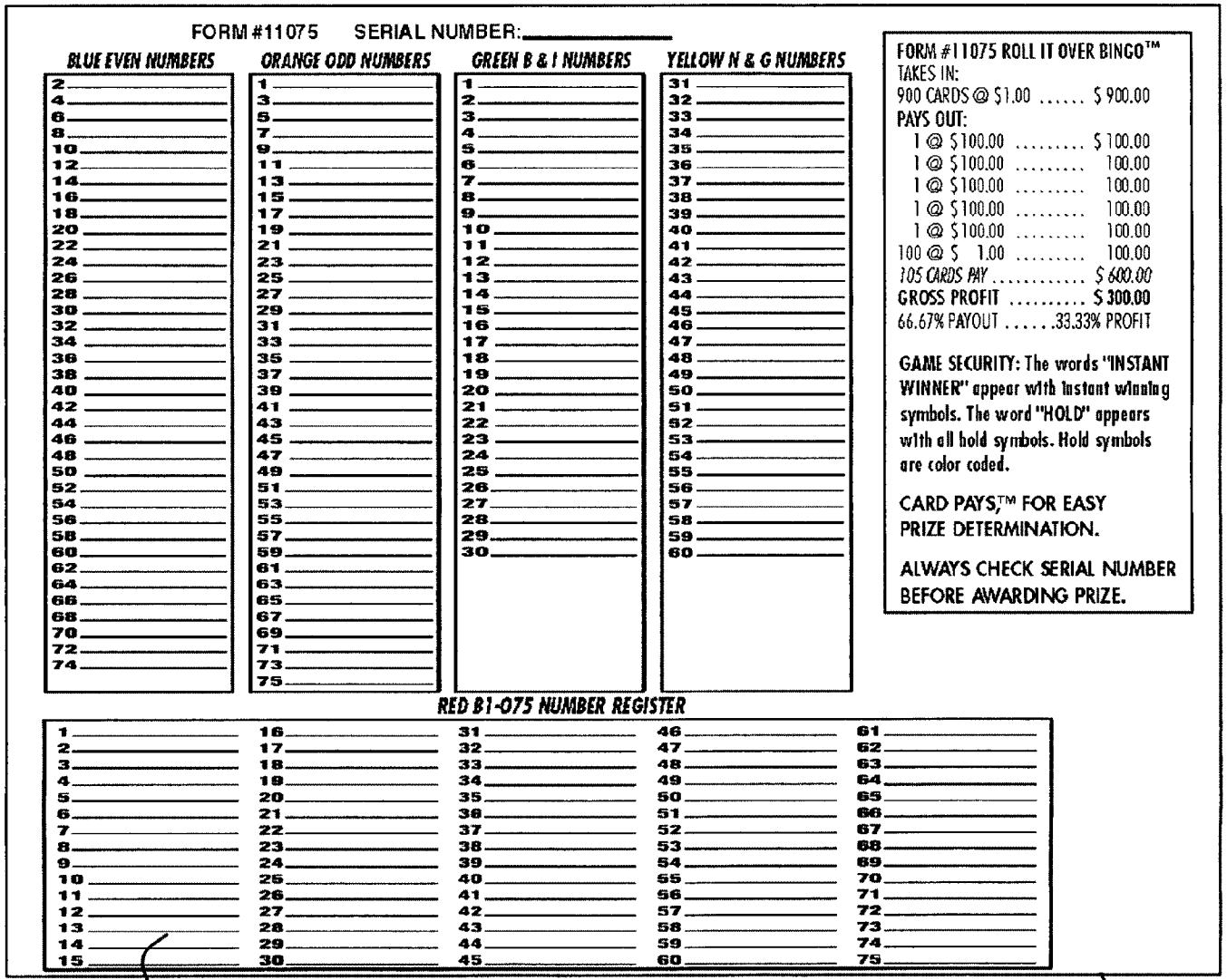
FIG. 13 is a plan view illustrating a registration card, in accordance with various embodiments of the present invention.

The game using the master card 110 of FIG. 9 may initially be played similarly to the game using the master card 10 of FIGS. 3-4. Thus, the master game card 110 is used in conjunction with a plurality of playing cards 140. As described above, each of these playing cards may be purchased by a game player, with certain ones of the players being eligible to participate in two or more levels of play with master game card 110, with or without prior or subsequent opportunity to win prizes or awards.

Figure 8:
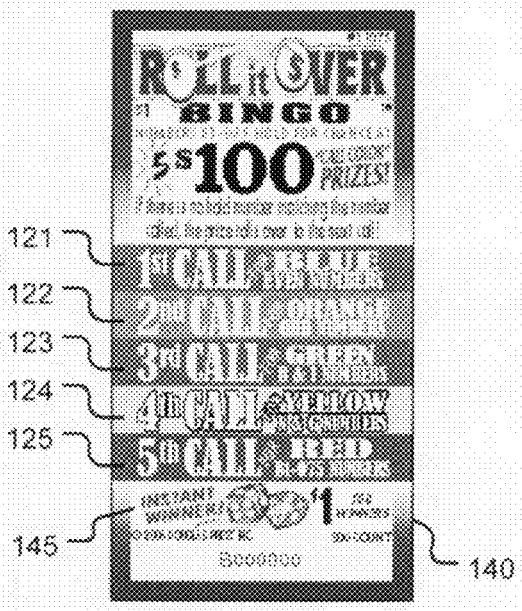
FIG. 8 is a plan view illustrating an outside surface of an upper ply of a playing card, in accordance with various embodiments of the present invention.

The game may be initiated in the same manner, by providing prizes to those players having playing cards 140 which display predetermined winning prize symbols 145—an instant winner. Another aspect of the present game system similarly involves establishing selected game players who become eligible to play in a plurality of bonus levels of play 121-125. These players may then be listed in a list arrangement 114 on the master game card 10 (not illustrated) or on a separate registration card 200, such as the one illustrated in FIG. 13. In the present embodiment, the eligibility of these selected players is established by those players having cards 40 having predetermined selected ones of the game symbols, such as symbols associated with particular bingo numbers/balls. The predetermined selected ones of the game symbols may be indicated on the master game card 110, on the player cards 40, or both. In the present embodiment, such predetermined game symbols comprise a combination of color, letter, and numeric designations—in particular color-coded, numeric designations corresponding to particular bingo balls (i.e., blue I-24, red O-72, green B-4, etc), as shown in FIG. 8. This may be reflected in list 114, for example.

The levels of play 121-125 indicated on the master game card 110 provide the additional levels of play of the present system. In one embodiment, a bingo number is drawn, which is then used in conjunction with the instructions on the master card 110 to determine whether there is a winner of the first bonus level of play. In the illustrated embodiment for example, only players holding playing cards 140 having blue, even bingo numbers may win at the first level of play. Thus, a drawing of O-73 would not produce a winner at the first level 121, while a drawing of I-16 might. Accordingly, it is possible that no winner at the first level of play 121 will be selected. Although the present embodiment is described as having five levels of play, other embodiments are possible having at least two levels of play.

In the present embodiment, it is contemplated that an individual (e.g., a game operator, a player, etc.) will draw only one bingo number for each of the successive levels of play. The master card 110 therefore may include indicia to that end. The values of the respective prizes for each of the levels of play are preferably prominently displayed at regions 127 on the master game card 110 so that game players are aware of the potential prizes they might win. Although the prize values 127 of the levels of play 121-125 denoted on the master card 110 in FIG. 9 are depicted as being equal to each other (i.e., all $100), it should be appreciated that the prize values may vary. For example, in one embodiment, the prize values may progressively increase (e.g., $100, $200, $300, etc.) as the levels of play increase.

Thus, the first level of play begins with a first bingo ball drawing. If the bingo number that is drawn matches a bingo symbol on a playing card 40 held by one or more eligible, selected players, the prize value associated with the first level of play 121 is awarded to the identified player(s). If, on the other hand, the number drawn does not match with any of the eligible, selected players, the prize for the first level of play rolls into the second prize value corresponding to the second level 122. For example, according to the illustrated embodiment, if "B-10" is drawn, then the player associated with the symbol "Blue B-10" wins $100. On the other hand, if an odd number such as N-45 is drawn, none of the selected players win the first level of play 121, and the associated $100 prize is rolled over into the second level of play 122. Accordingly, if none of the selected players won in the first level of play, the selected players would then be eligible for an accumulated prize of $200 in the second level of play 122. Similarly, if none of the selected players is identified as a winner of the second bonus level of play 122, the $200 accumulated prize from the second level of play is rolled over into the third bonus level of play 123, with the selected players therefore being eligible $300 in the third level 123, and so on through the remaining level(s) of play. To this end, the master card 110 includes indicia 129 indicating that if none of the selected players has won a particular level of play, the prize associated with that level of play rolls over into the prize for the next level of play.

In one embodiment, it may be desirous to ensure that all the prizes are ultimately awarded, or that a prize is awarded in certain intermediate levels. In such cases, a total of 75 players (e.g., Red B-1 through O-75 numbers), one for each possible bingo drawing, may be eligible for the desired level of play (e.g. the final level 125). Thus, regardless of which bingo number is drawn, it is guaranteed that upon the conclusion of that level of play, all of the prizes will have been awarded.

Thus, embodiments provide for a lottery-type game system with a rollover feature. The rollover feature enhances the entertainment value of the game, thereby increasing player interest in the game, and in turn, potential revenues generated from the sale of playing cards to such players.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A method for using an apparatus for controlling play of a lottery-type card-based game, the apparatus comprising:

a plurality of playing cards, each of which having one or more game symbols displayed thereon; and a master game card for use in conjunction with the plurality of playing cards;

at least one of the master game card and the plurality of playing cards including an eligibility indicator for establishing the eligibility of one or more selected game players holding playing cards displaying predetermined selected ones of the game symbols for playing a plurality of levels of play on the master game card, the master game card further including:

a first prize identifier comprising one or more first selectively removable members for determining whether there is a winner of a primary prize value associated with a first level of play in the game;

a second prize identifier comprising one or more second selectively removable members for determining the identity of a winner of a primary prize associated with a second, final level of play that is subsequent to, and in the same game as, the first level of play, wherein the second prize identifier is configured to guarantee a winner of the primary prize associated with the second level of play; and indicia displayed on at least one of the master card and the plurality of playing cards instructing the players as to how the game is to be played, said method comprising:

removing the one or more first selectively removable members to determine whether the entirety of the primary prize value associated with the first level of play has been won;

removing the one or more second selectively removable member to determine the identity, from amongst the eligible one or more selected game players, of the winner of the primary prize value associated with the second level of play; and awarding to the winner of the primary prize value associated with the second level of play any portion of the primary prize value associated with the first level of play that had not been won at the first level of play, together with any primary prize values carried forward from any level of play preceding the first level of play, such that all primary prize values of the game are finally distributed upon completion of the second level of play.

2. The method as recited in claim 1 wherein the first prize identifier comprises a plurality of player identifiers displayed on the master game card, and wherein further at least one of the player identifiers includes indicia that none of the selected game players has won the primary prize associated with the first level of play.

3. The method as recited in claim 2 wherein the first prize identifier further comprises a plurality of first selectively removable members which conceal the player identifiers, so that whether there is a first winner of the first level of play is determined by removing at least one of the removable members.

4. The method as recited in claim 3 wherein the master game card has displayed thereon indicia for indicating that only one of each of the player identifiers corresponding to the first prize identifier is to be revealed.

5. The method as recited in claim 3 wherein the master game card has displayed thereon indicia for indicating that two or more of the player identifiers corresponding to the first prize identifier are to be revealed.

6. The method as recited in claim 3 wherein the first selectively removable members comprise die-cut flaps which obscure the player identifiers until revealed.

7. The method as recited in claim 3 wherein the first selectively removable members comprise scratch-off coatings which obscure the first and second player identifiers until revealed.

8. The method as recited in claim 2 wherein at least one of the first player identifiers identifies one or more of the selected game players.

9. The method as recited in claim 1 wherein the second prize identifier comprises a plurality of player identifiers displayed on the master game card.

10. The method as recited in claim 9 wherein each of the player identifiers identifies one or more of the selected game players.

11. The method as recited in claim 1 wherein the master game card has displayed thereon indicia for indicating that the determination of whether there is a winner of the first level of play must be performed before the determination of whether there is a winner of the second level of play.

12. The method as recited in claim 1 wherein the master game card has displayed thereon indicia of the primary prize value associated with the first level of play.

13. The method as recited in claim 1 wherein the master game card has displayed thereon indicia of the primary prize value associated with the second level of play.

14. The method as recited in claim 1 wherein the master game card has displayed thereon a listing arrangement for listing the identity of the selected game players.

15. The method as recited in claim 1 wherein the primary prize values associated with the first and second levels of play are equal to each other.

16. The method as recited in claim 1 wherein the predetermined selected ones of the game symbols comprise particular numeric designations.

17. The method as recited in claim 1 wherein the predetermined selected ones of the game symbols comprise particular colors.

18. The method as recited in claim 1 wherein the master game card further comprises indicia of a total prize value, wherein the total prize value is based, at least in part, on the sum of the prize value assigned to first level of play and the prize value assigned to the second level of play.

19. The method as recited in claim 1 wherein the first and second prize identifiers are configured so that the odds of winning a particular level of play are not a function of how many previous levels of play have been played.

20. The method as recited in claim 1 wherein the playing cards include indicia displayed thereon indicating that at least one holder of at least one of the playing cards displaying at least one particular game symbols is an instant winners of one or more instant win prizes.

21. A method for using a system for controlling play of a lottery-type card-based game, the system comprising:

a plurality of playing cards, each of which having one or more selectively removable members concealing one or more game symbols, the playing cards further having displayed thereon indicia for establishing the eligibility of one or more selected game players having playing cards displaying predetermined selected ones of the game symbols for additional levels of play;

a symbol selection device for use in conjunction with the plurality of playing cards, Wherein the symbol selection device is operable to indicate an initial symbol for determining whether there is a winner of a primary prize value associated with an first level of play and a subsequent symbol for determining the identity of a winner of a primary prize value associated with a second, final level of play that is subsequent to, and in the same game as, the first level of play;

the playing cards further including indicia displayed thereon instructing the players as to how the game is to be played, said method comprising:

removing at least one of the selectively removable members to determine the eligibility of the one or more selected game players having playing cards displaying the predetermined selected ones of the game symbols for the additional levels of play;

receiving the initial symbol from the symbol selection device to determine whether the entirety of the primary prize value associated with the first level of play has been won;

receiving the subsequent symbol from the symbol selection device to determine the identity, from amongst the eligible one or more selected game players, of the winner of the primary prize value associated with the second level of play; and awarding to the winner of the primary prize value associated with the second level of play any portion of the primary prize value associated with the first level of play that had not been won at the first level of play, together with any primary prize values carried forward from any level of play preceding the first level of play, such that all primary prize values of the game are finally distributed upon completion of the second level of play.

22. A method of playing a lottery-type card-based game using a plurality of playing cards, each of which having one or more game symbols displayed thereon, and at least one master game card for use in conjunction with the playing cards, the master game card comprising at least one first selectively removable member and at least one second selectively removable member, the method comprising:

distributing at least a portion of the playing cards to a plurality of individual players;

selecting one or more of the individual players having playing cards displaying predetermined selected ones of the game symbols, to be eligible to play in at least a first level of play and a second, final level of play;

removing the at least one first selectively removable member to determine whether one or more of the selected individual players is a winner of a primary prize value identified by the at least one master game card and associated with a first level of play of the game;

determining the extent to which the primary prize value associated with the first level of play has not been won;

removing the at least one second selectively removable member to identify one or more winners of a primary prize value identified by the at least one master game card and associated with a second, final level of play that is subsequent to, and in the same game as, the first level of play;

awarding to the winner of the primary prize value associated with the second level of play any portion of the primary prize value associated with the first level of play that had not been won at the first level of play, together with any primary prize values carried forward from any level of play preceding the first level of play, such that all primary prize values of the game are finally distributed upon completion of the second level of play.

23. The method as recited in claim 22 wherein removing the first selectively removable member comprises revealing, on the master card, a previously concealed player identifier associated with the first level of play.

24. The method as recited in claim 22 wherein removing the second selectively removable member comprises revealing, on the master card, a previously concealed player identifier associated with the second level of play.

25. The method as recited in claim 22 further comprising:

provided one or more of the selected individual players are winners of the primary prize value associated with the first level of play, awarding the primary prize value associated with the first level of play to the one or more winners of the first level of play.

26. The method as recited in claim 25 further comprising:

provided one or more of the selected individual players are winners of the entirety of the primary prize value associated with the first level of play, awarding only the primary prize value associated with the second prize value to the one or more winners of the second level of play.

* * * * *